US011692407B1

(12) United States Patent
Al-Ghamdi

(10) Patent No.: US 11,692,407 B1
(45) Date of Patent: Jul. 4, 2023

(54) SYSTEMS AND METHODS FOR A MUDLINE SUSPENSION SYSTEM CORROSION CAP AND RUNNING TOOL WITH SHEARING SCREWS

(71) Applicant: SAUDI ARABIAN OIL COMPANY, Dhahran (SA)

(72) Inventor: Bakr Abdulrahim Al-Ghamdi, Dammam (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/049,528

(22) Filed: Oct. 25, 2022

(51) Int. Cl.
*E21B 33/037* (2006.01)

(52) U.S. Cl.
CPC ..... *E21B 33/0375* (2013.01)

(58) Field of Classification Search
CPC ..... E21B 33/0375
See application file for complete search history.

(56) References Cited

U.S. PATENT DOCUMENTS 10,472,914 B2 * 11/2019 Nguyen ..... E21B 23/01
10,947,789 B1 * 3/2021 Al-Abdulrahman ..... E21B 33/038

FOREIGN PATENT DOCUMENTS

CN 206129212 U 4/2017
WO 1982001393 A1 4/1982
WO WO-9516102 A1 * 6/1995 ..... E21B 19/002

* cited by examiner

*Primary Examiner* — Matthew R Buck
(74) *Attorney, Agent, or Firm* — Osha Bergman Watanabe & Burton LLP

(57) ABSTRACT

A system for installing a corrosion cap on a mudline suspension system may include a method of inserting the corrosion cap into a running tool. One or more drive pins of the corrosion cap may be slotted into one or more J-slots of the running tool. The one or more drive pins may be positioned in a circular section of the one or more J-slots. One or more shear screws may be set in holes of the running tool corresponding to a vertical section or a horizontal section of the one or more J-slots. The corrosion cap may be removably locked to the running tool. The corrosion cap is landed on the mudline suspension system of a well. The one or more shear screws may be sheared to disengage the corrosion cap from the running tool. The running tool may be retrieved to a surface above the well.

20 Claims, 14 Drawing Sheets

SYSTEMS AND METHODS FOR A MUDLINE SUSPENSION SYSTEM CORROSION CAP AND RUNNING TOOL WITH SHEARING SCREWS

BACKGROUND

In the oil and gas industry, operations may be performed in a well at various depths below the surface with downhole tools. For example, fluids are typically produced from a reservoir in a formation by drilling a wellbore into the formation, establishing a flow path between the reservoir and the wellbore, and conveying the fluids from the reservoir to the surface through the wellbore.

In offshore applications, the wellbore is drilled from a mudline (i.e., the seabed) via a drilling rig located in a body of water. Additionally, various casing strings lowered into the well to line the wellbore. As the drilling rig is at a surface (i.e., sea level) of the body of water, a weight of the casing strings may be transferred to the seabed with a mudline suspension system. The mudline suspension system may include hangers to transfer the weight of each casing string to the seabed. The mudline suspension system allows for offshore drilling operations to abandon the well safely and tie-back the well to surface for future use. Conventionally, when the well is being abandoned, a corrosion cap is installed on top of the well to protect the well and the threads of the hanger below mudline. A running tool is set on top of the corrosion cap and connected to drill pipe from an upper connection to surface. However, in conventional methods, when setting the corrosion cap, the corrosion cap may slip and fall from the running tool into the well. For example, sudden movements or a mud providing buoyancy to the corrosion cap during installation may cause the corrosion cap fall from the running tool. This may cause operation delays and damage to the well or the hanger threads below the corrosion cap.

SUMMARY OF DISCLOSURE

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a method for installing a corrosion cap at an offshore well site. The method may include inserting the corrosion cap into a running tool; slotting one or more drive pins of the corrosion cap into one or more J-slots of the running tool; positioning the one or more drive pins in a circular section of the one or more J-slots; setting one or more shear screws in holes of the running tool corresponding to a vertical section or a horizontal section of the one or more J-slots; removably locking the corrosion cap to the running tool; landing the corrosion cap on a mudline suspension system of a well; shearing the one or more shear screws to disengage the corrosion cap from the running tool; and retrieving the running tool to a surface above the well.

In another aspect, embodiments disclosed herein relate to a method for sealing a well of an offshore well site. The method may include removably locking a first corrosion cap to a first running tool, the removably locking of the first corrosion cap to the first running tool includes positioning one or more drive pins of the first corrosion cap in a one or more J-slots of the first running tool; and setting one or more first shear screws in holes of the first running tool accessing the one or more J-slots; landing the first corrosion cap on a first casing hanger of a mudline suspension system within the well; shearing the one or more first shear screws to disengage the first corrosion cap from the first running tool; retrieving the first running tool to a rig above the well; removably locking a second corrosion cap to a second running tool, the removably locking of the second corrosion cap to the second running tool includes: positioning one or more drive pins of the second corrosion cap in a one or more J-slots of the second running tool; and setting one or more second shear screws in holes of the second running tool accessing the one or more J-slots of the second running tool; landing the second corrosion cap on a second casing hanger of the mudline suspension system; shearing the one or more second shear screws to disengage the second corrosion cap from the second running tool; retrieving the second running tool to the rig.

In yet another aspect, embodiments disclosed herein relate to a system for installing a corrosion cap on a mudline suspension system. The corrosion cap may include a cap, a stab body extending below the cap, a cap mandrel extending above the cap, and one or more drive pins extend radially outward from the cap mandrel. A running tool may include a body extending from a first end to a second end. An opening may be provided at the second end to receive the cap mandrel. One or more J-slots may be disposed on an inner surface of the body. The one or more J-slots includes a vertical section, a horizontal section, and a circular section interconnected together to form a J-shaped slot. Holes extend through the body at the one or more J-slots. The one or more drive pins are slotted into the one or more J-slots. One or more shear screws may be set in the holes to engage the one or more drive pins and removably lock the corrosion cap within the running tool. The one or more shear screws may be sheared to disengage the corrosion cap from the running tool to set the corrosion cap on a casing hanger of mudline suspension system.

Other aspects and advantages of the invention will be apparent from the following description and the appended claims.

BRIEF DESCRIPTION OF DRAWINGS

The following is a description of the figures in the accompanying drawings. In the drawings, identical reference numbers identify similar elements or acts. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, shapes of the elements as drawn are not necessarily intended to convey any information regarding the actual shape of the elements and have been solely selected for ease of recognition in the drawing.

DETAILED DESCRIPTION

Figure 1:
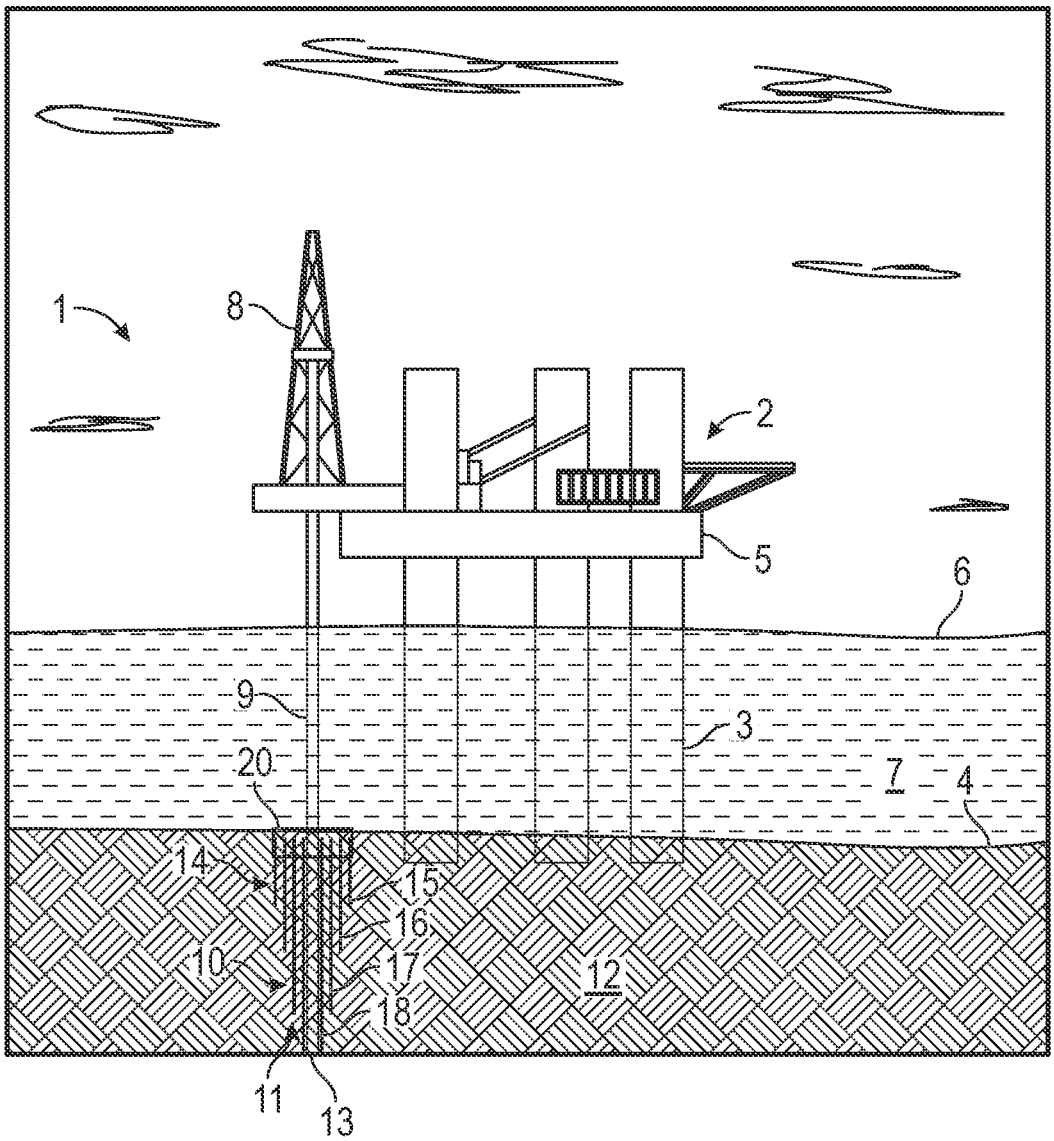
FIG. 1 illustrates a schematic diagram of a well system according to one or more embodiments of the present disclosure.

Embodiments of the present disclosure are described below in detail with reference to the accompanying figures. However, one skilled in the relevant art will recognize that implementations and embodiments may be practiced without one or more of these specific details, or with other methods, components, materials, and so forth. For the sake of continuity, and in the interest of conciseness, same or similar reference characters may be used for same or similar objects in multiple figures. Additionally, the figures are not necessarily to scale and certain features and certain views of the figures may be shown exaggerated in scale for purposes of clarification.

As used herein, the term "coupled" or "coupled to" or "connected" or "connected to" "attached" or "attached to" may indicate establishing either a direct or indirect connection, and is not limited to either unless expressly referenced as such. Further, embodiments disclosed herein are described with terms designating in reference to a tubular, but any terms designating should not be deemed to limit the scope of the disclosure. For example, the tubular string is made up of numerous tubular pipes joined end-to-end, and each of the tubular pipes might be about twenty to forty feet in length. Further, the tubular pipes are hollow and thus provide a continuous channel of communication between the surface and the bottom of the wellbore, down through which a suitable fluid can be introduced to any region required within the well. It is to be further understood that the various embodiments described herein may be used with various types of tubulars, including but not limited to casing or liners, without departing from the scope of the present disclosure. A casing generally refers to a large-diameter pipe that is lowered into an open-hole and cemented in place.

It is to be further understood that the various embodiments described herein may be used in various orientations, such as inclined, inverted, horizontal, vertical, etc., and in other environments, such as land or sub-sea, without departing from the scope of the present disclosure. Additionally, the various embodiments described herein may be used in various offshore structures, such as an offshore platform, offshore vessel, submersible rig, jack up rig, semi-submersible rig, drillship, or any type of offshore structure without departing from the scope of the present disclosure. It is to be further understood that the various embodiments described herein may be used in various stages of a well (land and/or offshore), such as rig site preparation, drilling, completion, abandonment etc., and in other environments, such as workover rigs, fracking installation, well-testing installation, oil and gas production installation, without departing from the scope of the present disclosure. The embodiments are described merely as examples of useful applications, which are not limited to any specific details of the embodiments herein.

Embodiments disclosed herein relate generally to systems and methods for using a mudline suspension system allowing for offshore drilling operations to abandon a well safely and tie-back the well to a surface. More specifically, embodiments disclosed herein are directed to installing a corrosion cap of a mudline suspension system with a running tool on top of a well to seal a wellbore. The running tool holds the corrosion cap with shear screws, and the running tool lowers the corrosion cap on top of the well. After the corrosion cap is installed on top of the well, the screws are sheared by applying torque or pulling on the running tool. The running tool may then be retrieved to the surface leaving the corrosion cap to seal off the well for abandon and/or later use. Overall, the corrosion cap held by the running tool with shear screws as described herein may reduce product engineering, reduction of assembly time, hardware cost reduction, and weight and envelope reduction. The one or more embodiments of a method for installing the corrosion cap held by the running tool with shear screws results in preventing the corrosion cap from slipping out of the running tool and falling into the well, improved well sealing for abandonment, tie-back the well to surface for future use, and reduction in operational costs associated with conventional well abandonment or well plugging operations.

Now referring to FIG. 1, an offshore well site 1 using a drilling rig 2 is illustrated. Initially, the drilling rig 2 may be towed to the offshore well site 1 by support vessels (e.g., tugboats). At the offshore well site 1, legs 3 of the drilling rig 2 are lowered into a seabed 4. With the legs 3 landed on the seabed 4, a hull 5 of the drilling rig 2 is elevated above a surface 6 of the body of water 7. Next, a derrick 8 of the drilling rig 2 may be cantilevered out from the hull 5 to begin drilling. Additionally, tubulars 9, such as a riser or casing string, may be extend from the derrick 8 to the seabed 4 to protect equipment and isolate a well 10 from the body of water 7. With the drilling rig 2 set, the well 10 is formed by drilling a wellbore 11 extending from a mudline (i.e., the seabed 4) into a subterranean formation 12 with a drill string 13. In general, there may be many layers of the subterranean formations 12 below the mudline 4.

To complete the well 10, the well 10 includes a casing profile 14 within the wellbore 11 to complete the well 1. The casing profile 14 includes multiple casing strings, such as a conductor casing 15, a surface casing 16, an intermediate casing 17, and a production casing 18. The conductor casing 15 may be a large-diameter casing that protects shallow formations from contamination by drilling fluid and helps prevent washouts involving unconsolidated topsoil and sediments. The surface casing 16, the second string, has a smaller diameter than the conductor casing 15, maintains borehole integrity and prevents contamination of shallow groundwater by hydrocarbons, subterranean brines and drilling fluids. The intermediate casing 17, the third string, has a smaller diameter than the surface casing 16, isolates hydrocarbon-bearing, abnormally pressured, fractured and lost circulation zones, providing well control as engineers drill deeper. Multiple strings of the intermediate casing 17 may be required to reach the target producing zone. The production casing 18, or liner, is the last and smallest tubular element in the completed well 10. The production casing 18 isolates the zones above and within the production zone and withstands all the anticipated loads throughout the well's life. Additionally, the production casing 18 may be perforated to allow hydrocarbons to flow into the production casing 18. Furthermore, each casing string 15-18 undergoes a cement operation. Typically, a well section is drilled, then a casing string (e.g., the conductor casing 15, the surface casing 16, the intermediate casing 17, or the production casing 18) is lowered into the wellbore 11 and then cemented with a cement slurry. The cement slurry is a combination of cement, cement additives, and water.

Figure 2:
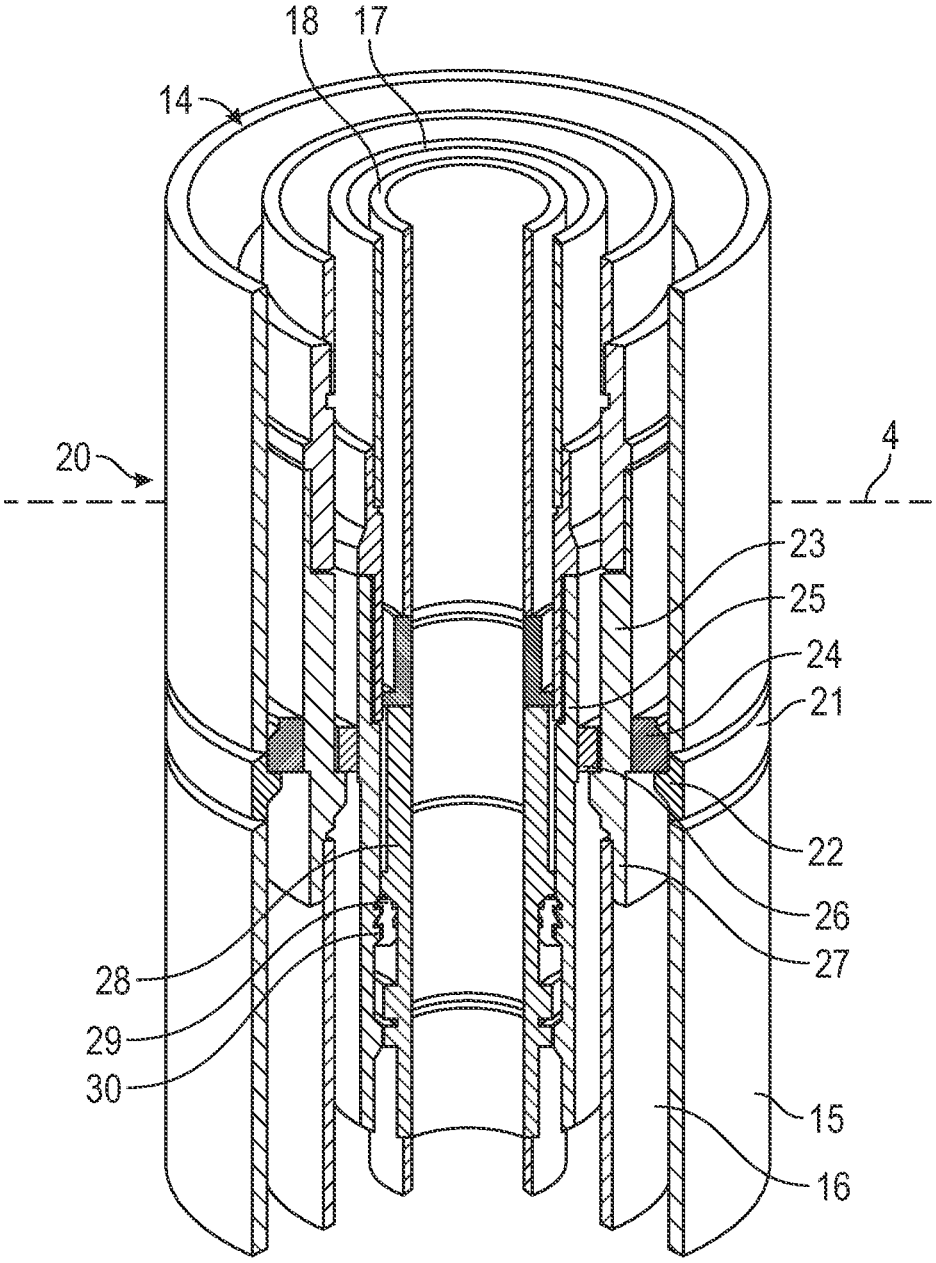
FIG. 2 illustrates schematic diagram of a mudline suspension system according to one or more embodiments of the present disclosure.

To support the casing profile 14, a mudline suspension system 20 may be used to transfer the weight of each casing string 15-18 to the seabed 4. The mudline suspension system 20 provides casing hangers corresponding to each casing string 15-18. As shown in FIG. 2, a sub 21 is butt-welded into the conductor casing 15 to provide a landing shoulder 22 for the mudline suspension system 20. The mudline suspension system 20 includes a first casing hanger 23 having an outer flange 24 that lands on the landing shoulder 22 formed on the butt-welded sub 21. The first casing hanger 23 supports the weight of the surface casing 16. Additionally, the mudline suspension system 20 also includes a second casing hanger 25 having an outer flange 26 that lands on an internal shoulder 27 of the first casing hanger 23. The second casing hanger 25 supports the weight of the intermediate casing 17. Further, the mudline suspension system 20 also includes a third casing hanger 28 having a seal assembly 29 that lands on an internal assembly 30 of the second casing hanger 25. The third casing hanger 28 supports the weight of the production casing 18. FIG. 2 illustrates one example of a mudline suspension system and various alternative arrangements for the mudline suspension system may be used without departing the scope of the present disclosure.

In one or more embodiments, the mudline suspension system 20 may be used to temporarily abandon the well 10 at any time during the life of the offshore well site 1. To seal off the well 10 for abandonment, one or more corrosion caps may be installed on the mudline suspension system 20 with a running tool through the tubulars 9. For example, a tubular string (i.e., a drill pipe string) may be connected to the running tool and the tubular string lowers the running tool through the tubulars 9. At an end of the running tool opposite the tubular string, the one or more corrosion caps is removably coupled to the running tool such that when the running tool is lowered, the one or more corrosion caps is at a lowermost point to land on the mudline suspension system 20.

Figure 3:
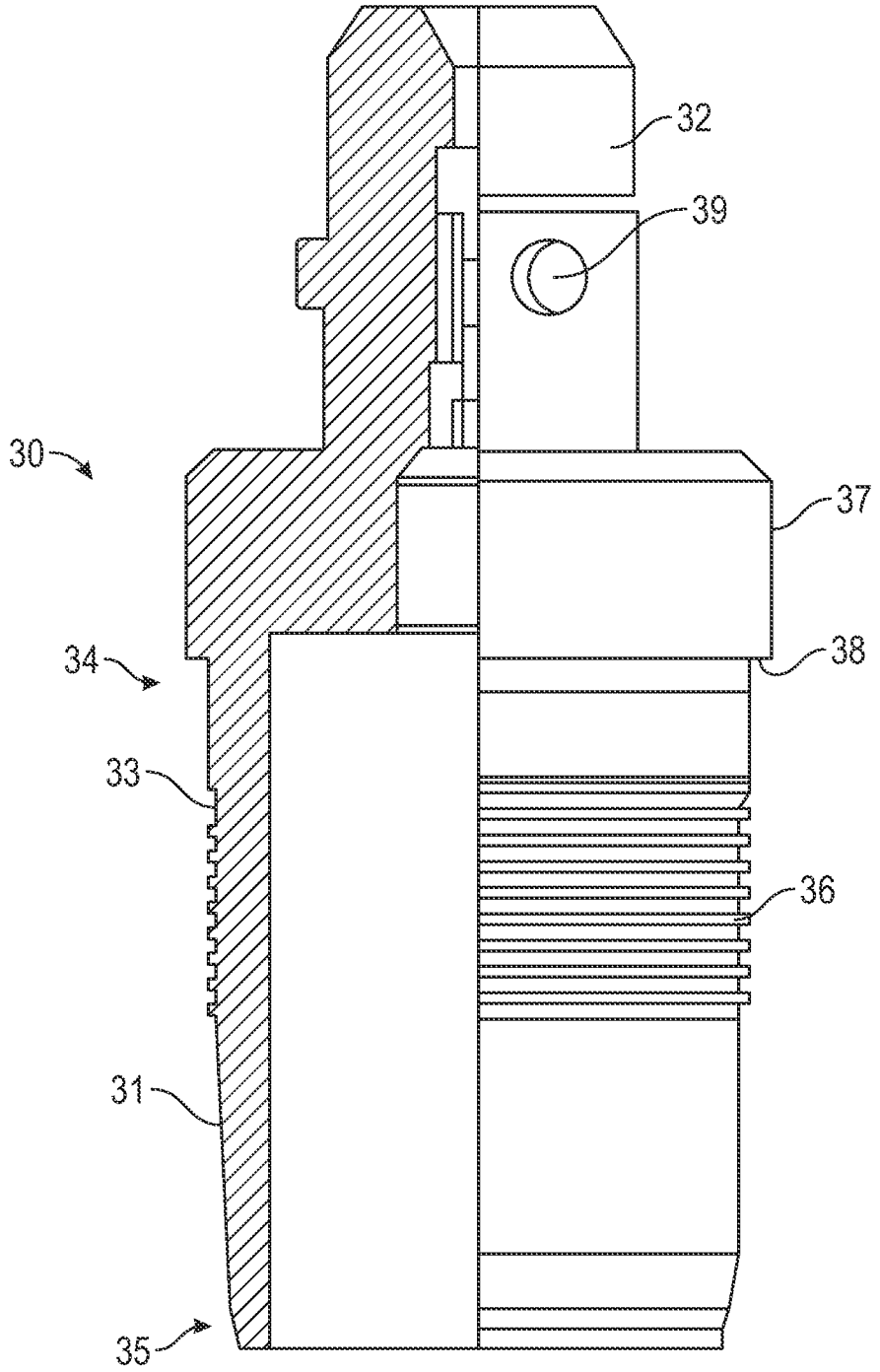
FIG. 3 illustrates schematic partial cross-sectional diagram of a corrosion cap according to one or more embodiments of the present disclosure.

As shown in FIG. 3, a corrosion cap 30 may have a stab body 31 (i.e., lower portion), a cap 37 (i.e., middle portion), and a cap mandrel 32 (i.e., upper portion). The stab body 31 extends downward from the cap 37 and the cap mandrel 32 extends upward from the cap 37. The stab body 31 is used to engage a casing hanger, the cap 37 is used to seal of an upper end of casing hanger, and the cap mandrel 32 is used to engage/disengage a running tool. For example, the stab body 31 has an outer surface 33 that may be tapered from an upper end 34 to a lower end 35. The tapered outer surface 33 seals against an inner surface of the casing hanger of the mudline suspension system. An outer diameter of the stab body 31 is based on the inner diameter of the corresponding casing hanger configured to receive the corrosion cap 30. Additionally, the tapered outer surface 33 may include seal elements 36, such as threads, elastomer seals, or O-rings, to engage, seal, and protect corresponding threads on the inner surface of the casing hanger. Further, the lower end 35 may be beveled to form a landing surface against an internal shoulder of the casing hanger.

In one or more embodiments, the cap 37 of the corrosion cap 30 is between the stab body 31 and the cap mandrel 32. The cap 37 may include a bottom stop 38 adjacent to the stab body 31 and distal to the cap mandrel 32. The bottom stop 38 abuts against a top (i.e., the uppermost end) of the casing hanger to limit a downward movement of the corrosion cap 30. Additionally, the cap 37 may have an outer diameter larger than the stab body 31 such that the stab body 31 is inserted into the casing hanger and the cap 37 land on the top of the casing hanger.

Still referring to FIG. 3, the cap mandrel 32 may include one or more drive pins 39 to engage the running tool. For example, the one or more drive pins 39 extend radially outward from the cap mandrel 32. The one or more drive pins 39 may have a circular profile to match a corresponding slot in the running tool.

Figure 4:
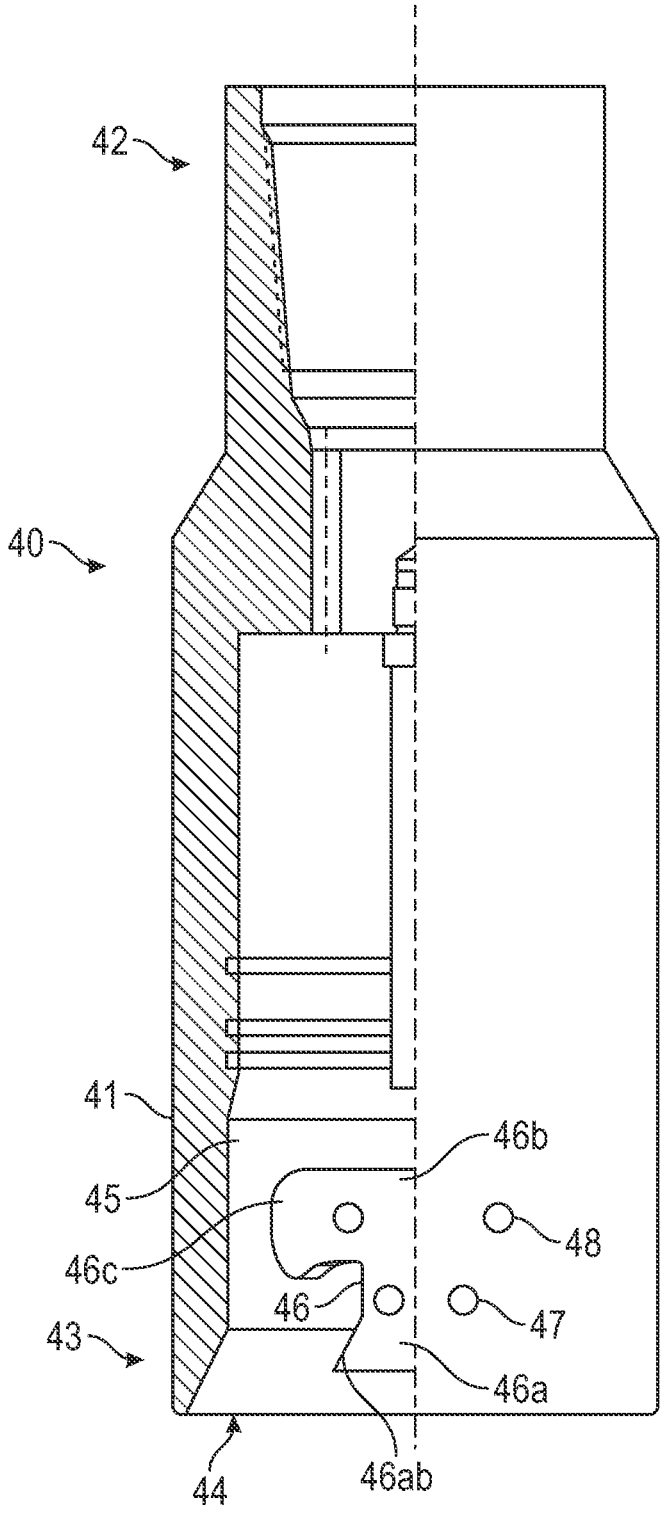
FIG. 4 illustrates schematic partial cross-sectional diagram of a running tool according to one or more embodiments of the present disclosure.

Now referring to FIG. 4, a running tool 40 for deploying the corrosion cap (30) is illustrated. The running tool 40 include a body 41 extending from a first end 42 to a second end 43. The first end 42 may be a connection end (e.g., threaded connection) to couple to the running tool 40 to the tubular string or other downhole tools to lower the running tool 40 into the well. The second end 43 may include an opening 44 to receive the cap mandrel (32) of the corrosion cap (30).

In one or more embodiments, adjacent the opening 44, an inner surface 45 of the body 41 may include one or more J-slots 46 to receive the one or more drive pins (39) of the cap mandrel (32). The running tool 40 may have any number of J-slots (46) corresponding to match the number of drive pins (39). The one or more J-slots 46 include a vertical section 46*a*, a horizontal section 46*b*, and a circular section 46*c* interconnected together to form a J-shaped slot inside the running tool 40. The vertical section 46*a* may also include an enlarged portion 46*ab* to create more space to receive and guide the one or more drive pins (39). Distal to the enlarged portion 46*ab*, the horizontal section 46*b* is connected to the vertical section 46*a* such that the one or more drive pins (39) are inserted into the J-slot such that they travel through the vertical section 46*a* and enter the horizontal section 46*b*. At end of the horizontal section 46*b* opposite the vertical section 46*a*, the circular section 46*c* is provided in communication with the horizontal section 46*b* such that the one or more drive pins (39) is slotted into the circular section 46*c* from the horizontal section 46*b*. The circular section 46*c* may have a profile to match the profile of the one or more drive pins (39). That is, the vertical and horizontal parts of the j-slot (46*a*, 46*b*) are there to guide the drive pins (39) to the circular section 46*c*, and this is where the drive pins (39) remain during the corrosion cap installation operation.

Still referring to FIG. 4, holes (47, 48) may extend through the body 41 from an outer surface to the inner surface 45. The holes (47, 48) are positioned within the one or more J-slots 46. The holes (47, 48) receive shear screws to removably lock the cap mandrel (32) within the body 41. For example, when the shear screws are inserted into a first hole 47, the shear screws extend into the vertical section 46*a* of the one or more J-slots 46. In the vertical section 46*a*, a pulling force (i.e., upward movement) is required to shear the shear screws. In another example, when the shear screws are inserted into a second hole 48, the shear screws extend into the horizontal section 46*b* of the one or more J-slots 46. In the horizontal section 46*b*, a rotational force (i.e., torque) is required to shear the shear screws. In some embodiments, the shear screws may be inserted in a hole in communication with the circular section 46*c*.

Figure 5:
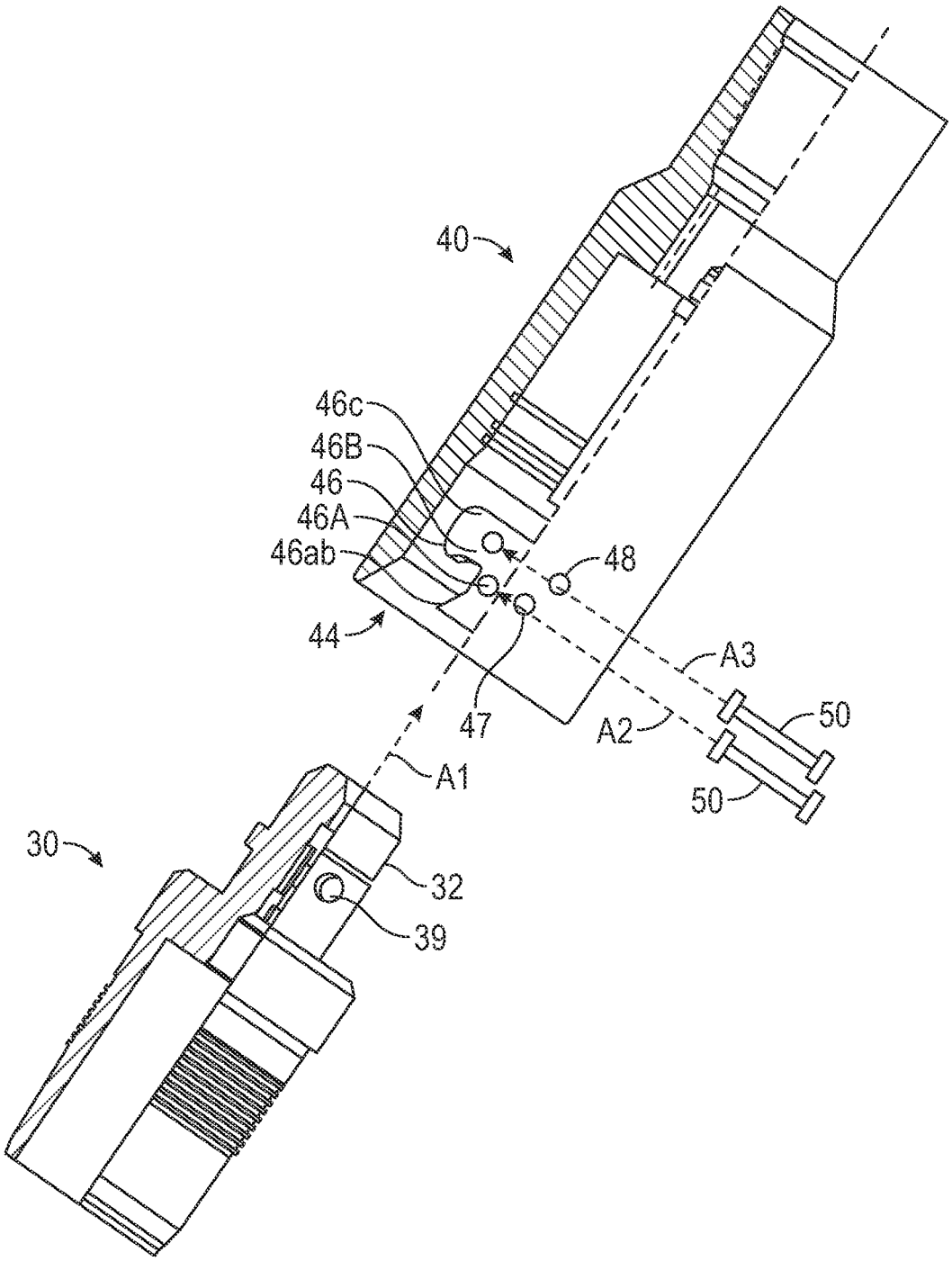
FIGS. 5-11 illustrate schematic diagrams of installing a corrosion cap with a running tool at a well system according to one or more embodiments of the present disclosure.

Now referring to FIGS. 5-11, in one or more embodiments, schematic diagrams of installing the corrosion cap 30 of FIG. 3 using the running tool 40 of FIG. 4 at the offshore well site 1 of FIG. 1 are shown. As shown in FIG. 5, in a first step, the corrosion cap 30 is removably coupled to the running tool 40 on the hull (5) or the derrick (8) of the drilling rig (2). The cap mandrel 32 of the corrosion cap 30 is inserted (see dotted arrow A1) into the opening 44 of the running tool 40. For example, the running tool 40 may be lifted and lowered on top of the corrosion cap 30.

In one or more embodiments, the one or more drive pins 39 are slotted into the corresponding one or more J-slots 46. For example, the one or more drive pins 39 are guided through the enlarged portion 46*ab* to enter the vertical section 46*a*. From the vertical section 46*a*, the one or more drive pins 39 moves into the horizontal section 46*b* and then is slotted into the circular section 46*c*. Next, one or more shear screws 50 are inserted (see dotted arrow A2 or A3) into either the first hole 47 or the second hole 48. For example, the one or more shear screws 50 may be inserted (see dotted arrow A2) into the first hole 47 and an end of the one or more shear screws 50 lays within the vertical section 46*a*. Alternatively, the one or more shear screws 50 may be inserted (see dotted arrow A3) into the second hole 48 and an end of the one or more shear screws 50 lays within the horizontal section 46*b*. The one or more shear screws 50 removably lock the corrosion cap 30 within the running tool 40 to prevent the corrosion cap 30 from slipping and dropping away from the running tool 40 into the well. In some embodiments, the one or more shear screws 50 may include nuts at the ends of the shear screws such that one nut is within the one or more J-slots 46 and the other nut is outside of the running tool 40.

Figure 6:
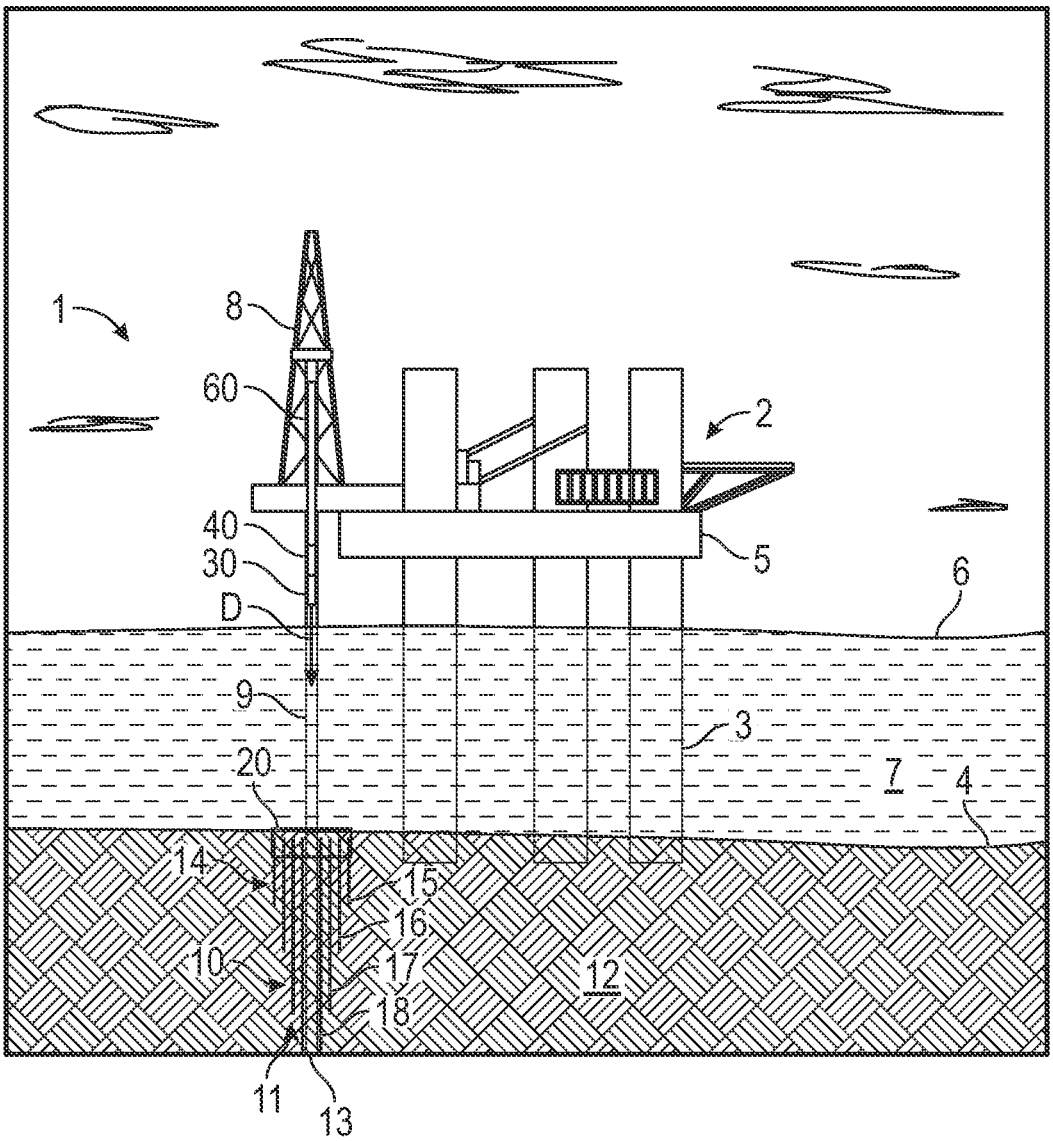

Now referring to FIG. 6, with the corrosion cap 30 removably locked within the running tool 40, the first end 42 (i.e., connection end) of the running tool 40 is coupled to a tubular string 60 on the derrick 8. The tubular string 60 may include a plurality of tubulars, such as drill pipe, connected end-to-end to reach the mudline suspension system 20. From the derrick 8, the tubular string 60 is lowered down (see arrow D) the riser 9 to position the corrosion cap 30 within the mudline suspension system 20.

Figure 7A:
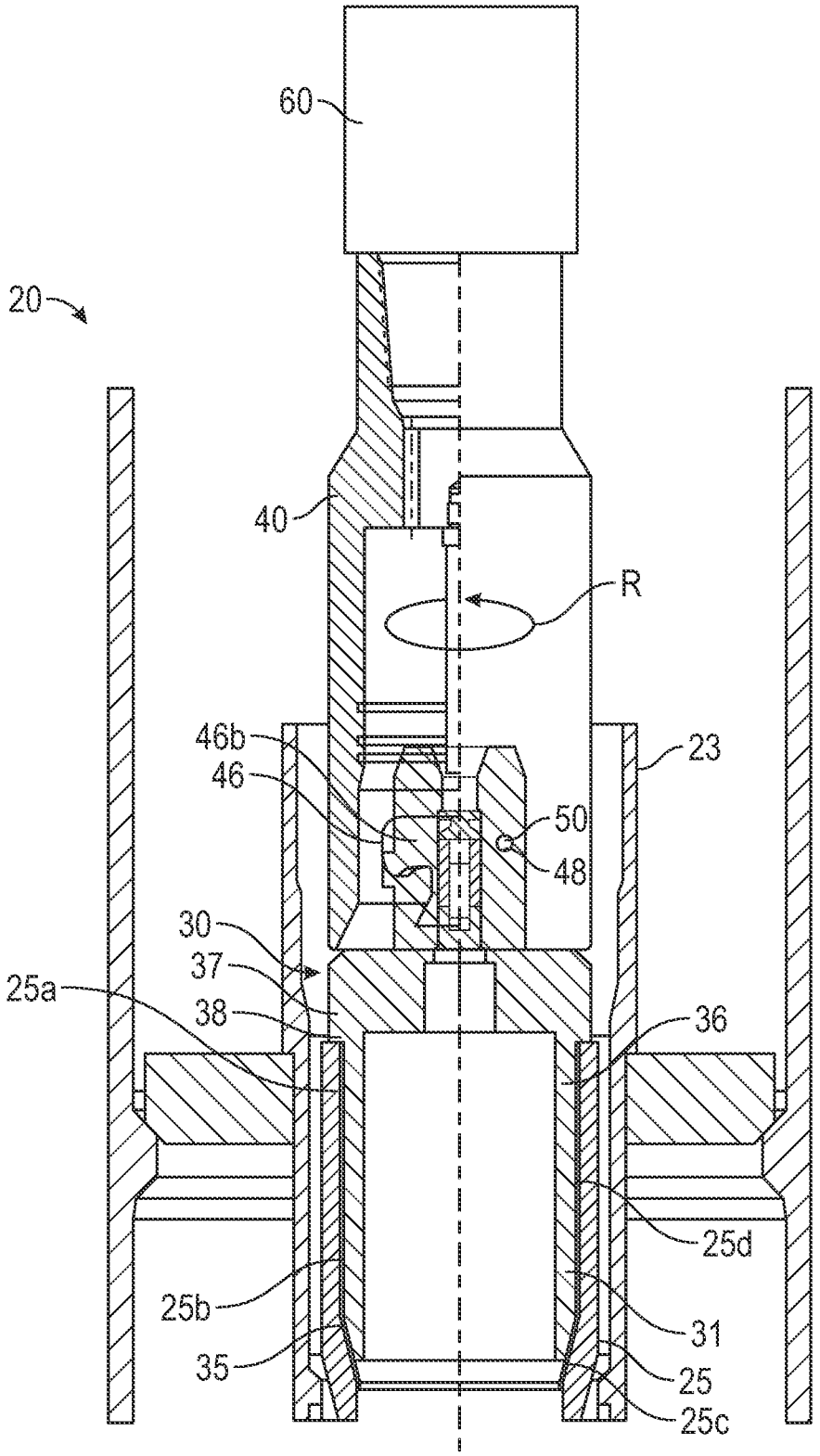
Figure 7B:
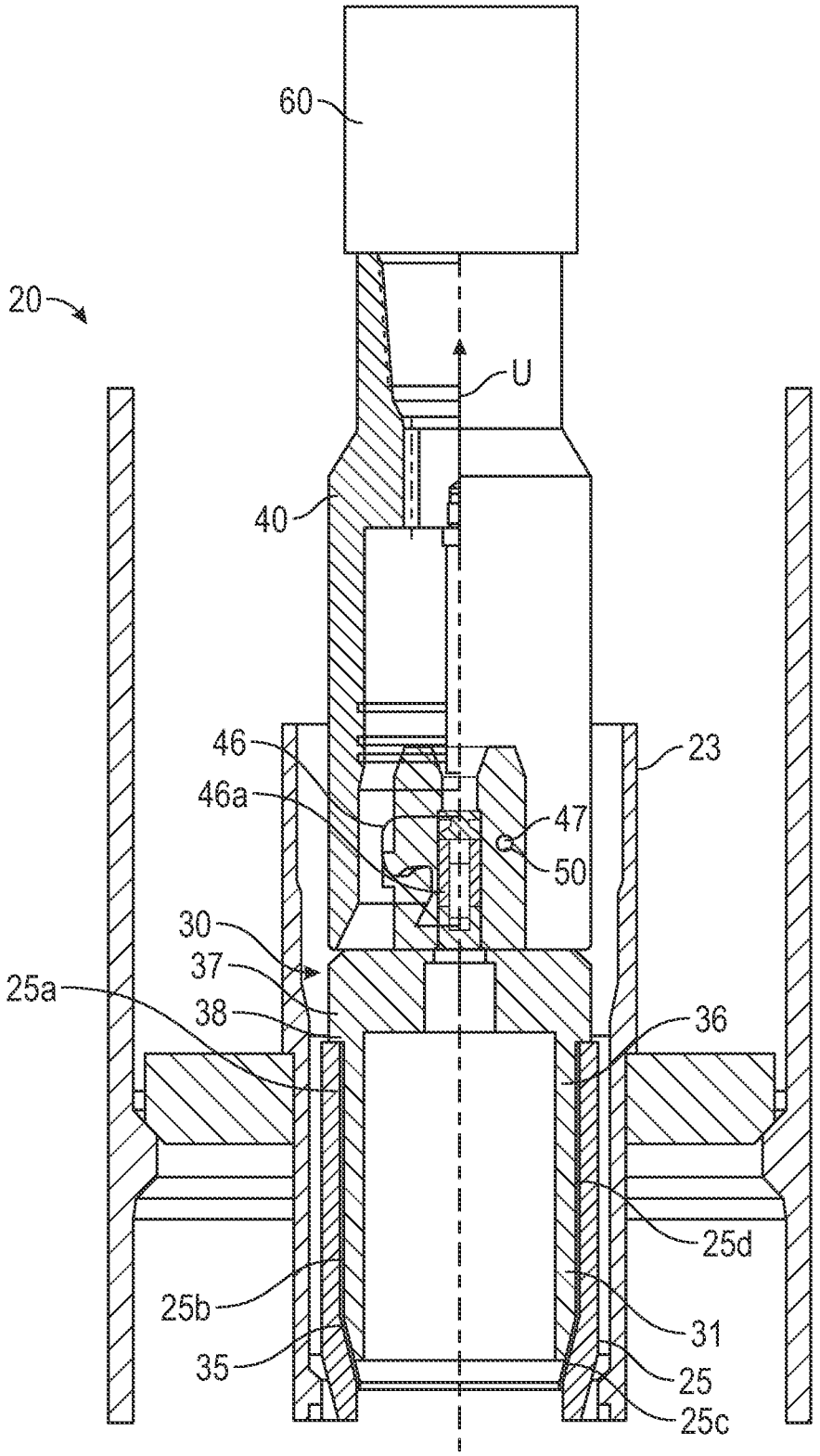

As shown in FIGS. 7A-7B, the running tool 40 is lowered by the tubular string 60 to land the corrosion cap 30 within the mudline suspension system 20. For example, the corrosion cap 30 may be a first corrosion cap sized to land within the second casing hanger 25 and be encompassed by the first casing hanger 23. For example, the bottom stop 38 of the cap 37 abuts against an upper most surface 25*a* of the second casing hanger 25. Additionally, the stab body 31 seals against an inner surface 25*b* of the second casing hanger 25. Further, the beveled lower end 35 of the first corrosion cap 30 lands on an internal shoulder 25*c* of the second casing hanger 25. To protect threads 25*d* provided on the inner surface 25*b* of the second casing hanger 25, the seal elements 36 on the stab body 31 engage and seal the threads 25*d*.

In one or more embodiments, to disengage the first corrosion cap 30 from the running tool 40, the running tool 40 is either rotated or pulled upward to shear the one or more shear screws 50. For example, as shown in FIG. 7A, the one or more shear screws 50 are inserted in the second hole 48, the running tool 40 is rotated (see arrow R) to provide a required torque to shear the one or more shear screws 50. The required torque may be based on a strength and quantity of the one or more shear screws 50.

Alternatively, as shown in FIG. 7B, the one or more shear screws 50 are inserted in the first hole 47, the running tool 40 is pulled (see arrow U) to provide a required upward force to shear the one or more shear screws 50. The required upward force may be based on a strength and quantity of the one or more shear screws 50.

Figure 8:
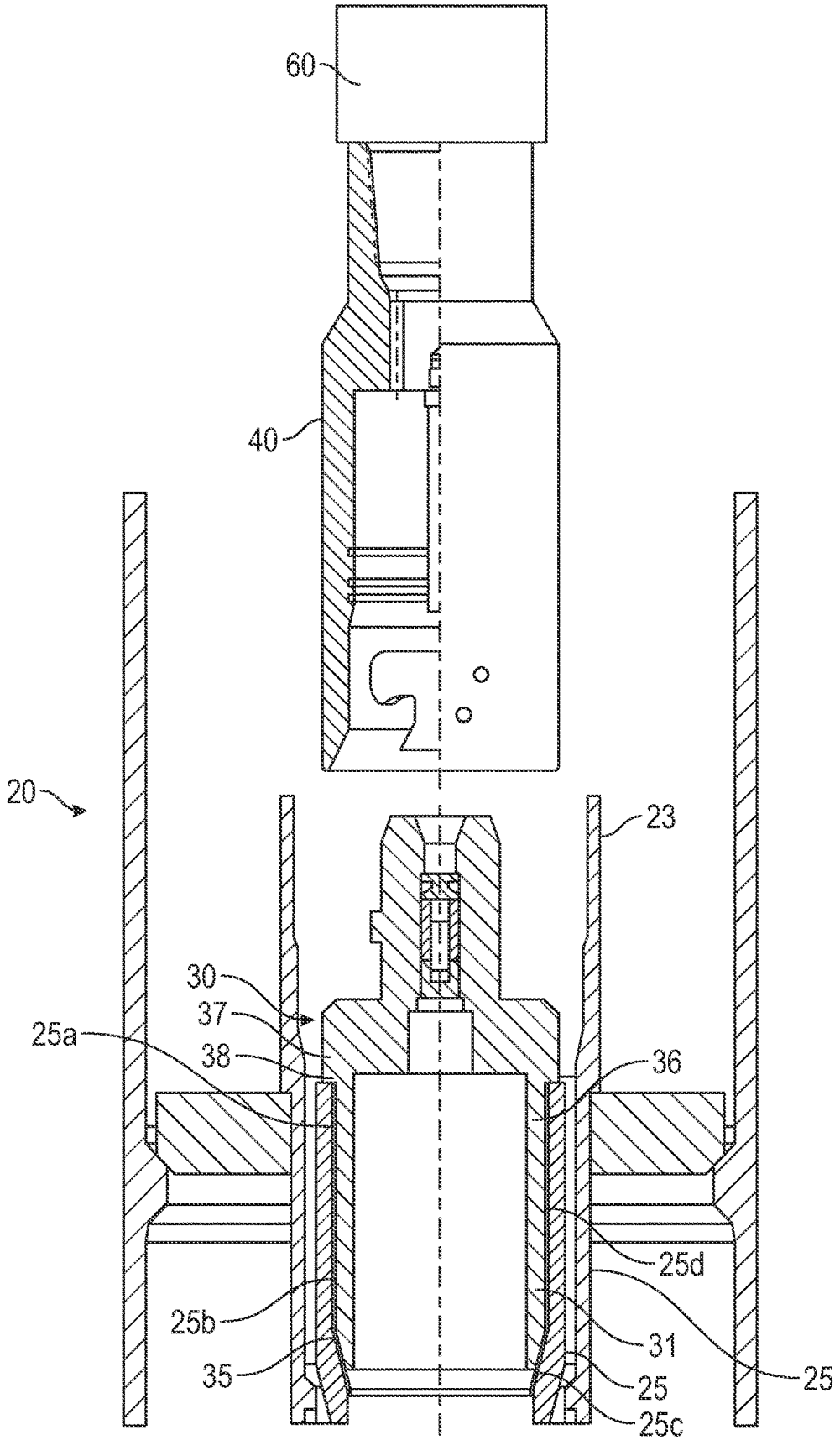

Now referring to the FIG. 8, with the one or more shear screws (50) sheared, the first corrosion cap 30 is set within the second casing hanger 25 to seal access to the intermediate casing (17). Additionally, the running tool 40 is moved upward to be retrieved at the surface (i.e., derrick 8) via the tubular string 60.

Figure 9A:
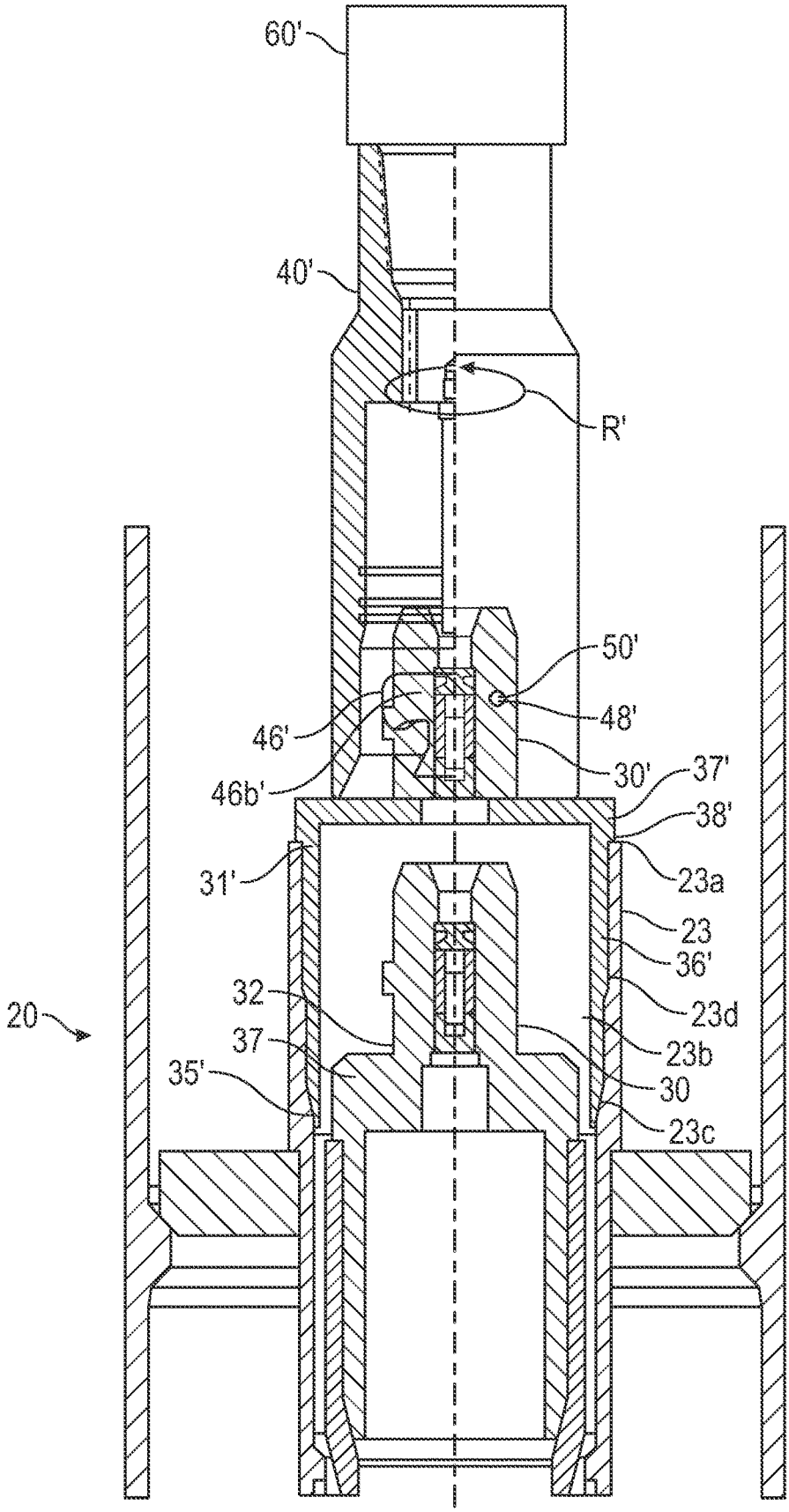

Referring to FIG. 9A, with the first corrosion cap 30 set, a second corrosion cap 30' may be deployed. The second corrosion cap 30' may be similar to the first corrosion cap 30. However, the second corrosion cap 30' is larger than the first corrosion cap 30 such that the second corrosion cap 30' is designed to land and seal on the first casing hanger 23. To land the second corrosion cap 30' on the first casing hanger 23, the steps described in FIGS. 5-8 may be repeated. For example, the second corrosion cap 30' is removable coupled to a second running tool 40*b*' The second running tool 40*b* is similar to the running tool 40 but larger to accommodate the increased size of the second corrosion cap 30'. The second running tool 40' is lowered down the riser (9) with a second tubular string 60' to land the second running tool 40' on the first casing hanger 23.

As shown in FIG. 9A, the second corrosion cap 30' may be sized to land within the first casing hanger 23. The stab body 31' of the second corrosion cap 30' may encompass the cap 37 and the cap mandrel 32 of the first corrosion cap 30. Additionally, the bottom stop 38' of the cap 37' of the second corrosion cap 30' abuts against an upper most surface 23*a* of the first casing hanger 23. Further, the stab body 31' seals against an inner surface 23*b* of the first casing hanger 23. Furthermore, the beveled lower end 35' of the second corrosion cap 30' lands on an internal shoulder 23*c* of the first casing hanger 23. To protect threads 23*d* provided on the inner surface 23*b* of the first casing hanger 23, the seal elements 36' on the stab body 31' engage and seal the threads 23*d*.

Figure 9B:
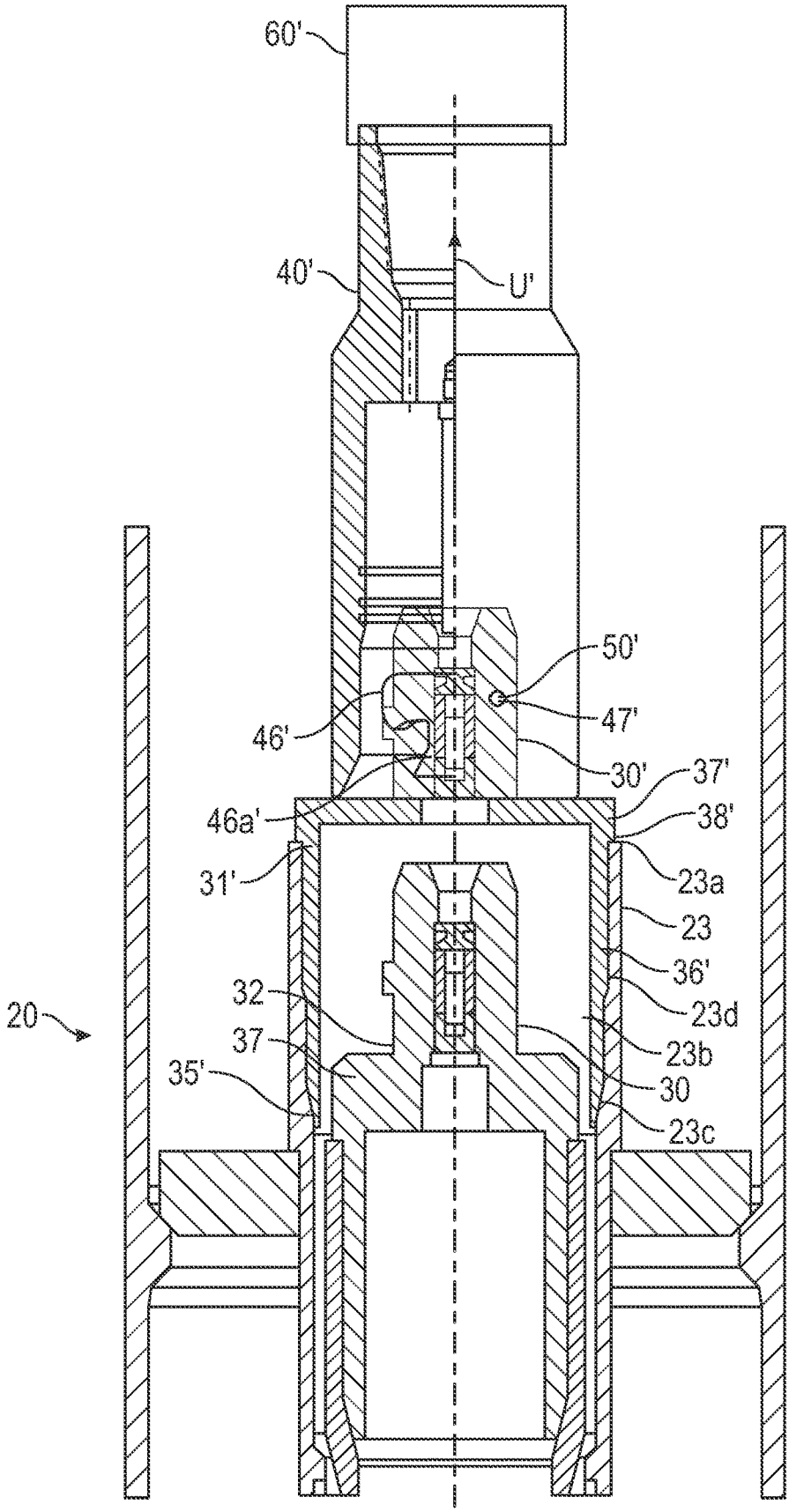

In one or more embodiments, to disengage the second corrosion cap 30' from the second running tool 40', the second running tool 40' is either rotated or pulled upward to shear the one or more shear screws 50'. For example, as shown in FIG. 9A, the one or more shear screws 50' are inserted in the second hole 48', the second running tool 40' is rotated (see arrow R') to provide a required torque to shear the one or more shear screws 50'. The required torque may be based on a strength and quantity of the one or more shear screws 50'. Alternatively, as shown in FIG. 9B, the one or more shear screws 50' are inserted in the first hole 47', the second running tool 40' is pulled (see arrow U) to provide a required upward force to shear the one or more shear screws 50'. The required upward force may be based on a strength and quantity of the one or more shear screws 50'.

Figure 10:
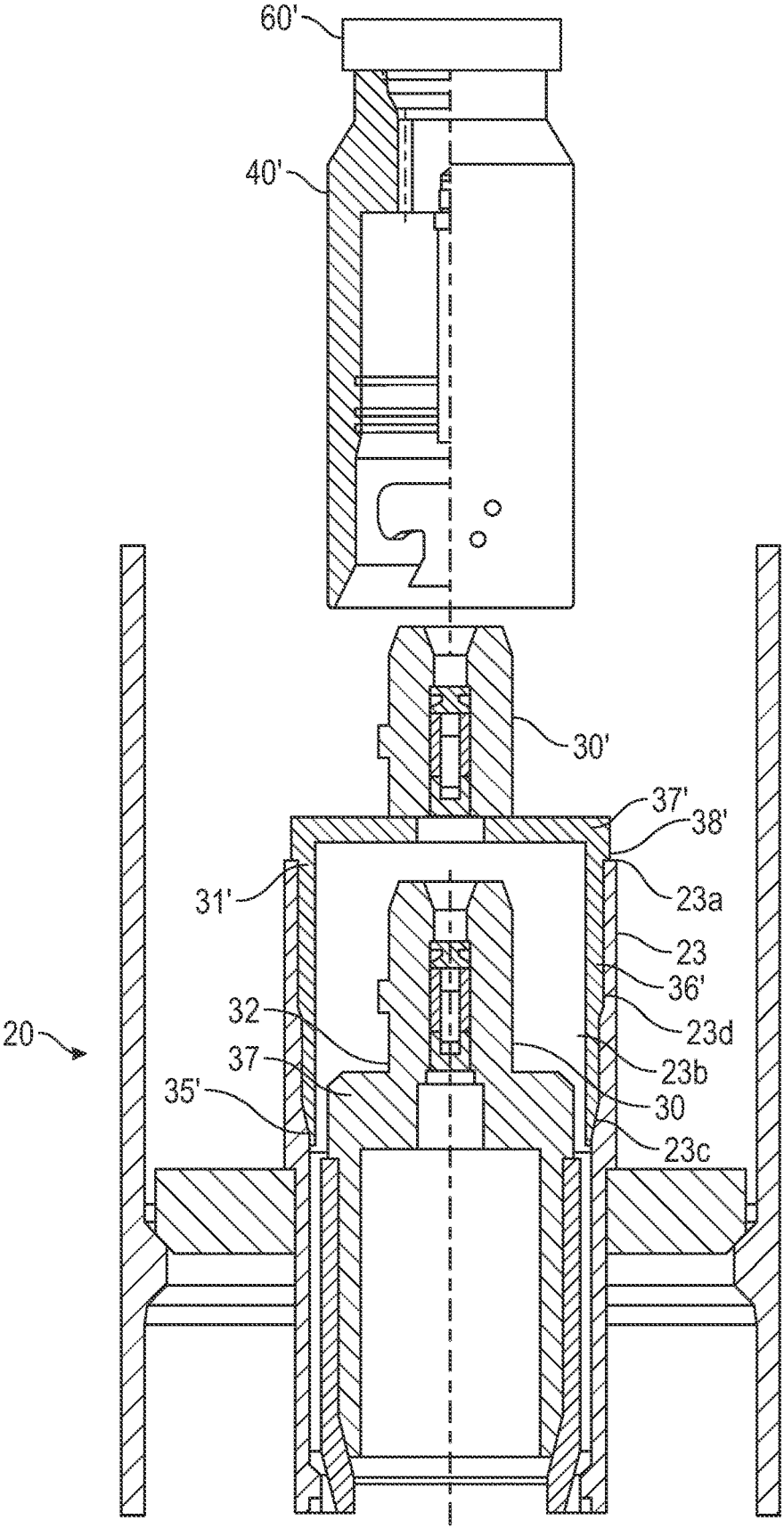

Now referring to the FIG. 10, with the one or more shear screws (50') sheared, the second corrosion cap 30' is set within the first casing hanger 23 to seal access to the surface casing (16). Additionally, the second running tool 40' is moved upward to be retrieved at the surface (i.e., derrick 8) via the second tubular string 60'.

Figure 11:
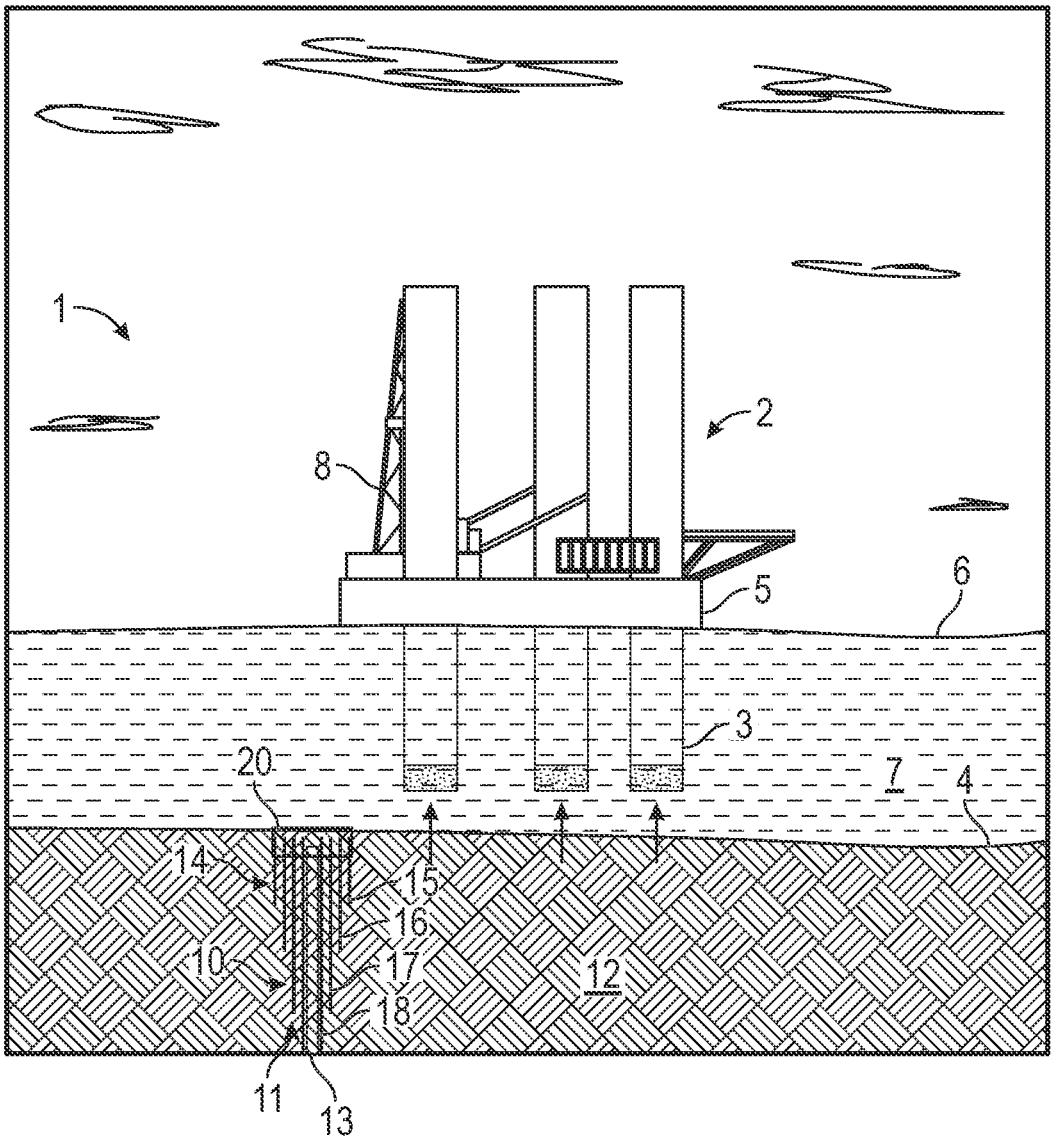

With the first corrosion cap 30 and the second corrosion cap 30' set, the well 10 at the offshore well site 1 may be seal for temporary or permanent abandonment. As shown in FIG. 11, the riser (9) is then removed along with any equipment above the mudline 4. Additionally, the derrick 8 may be pulled back onto the hull 5. Further, the legs 3 may be raised off the seabed 4 and the hull 5 is lowered onto the surface 6 of the body of water 7. From this position, the drilling rig 2 may be towed away from the offshore well site 1, thereby abandoning the well 10 permanently or temporarily.

Figure 12:
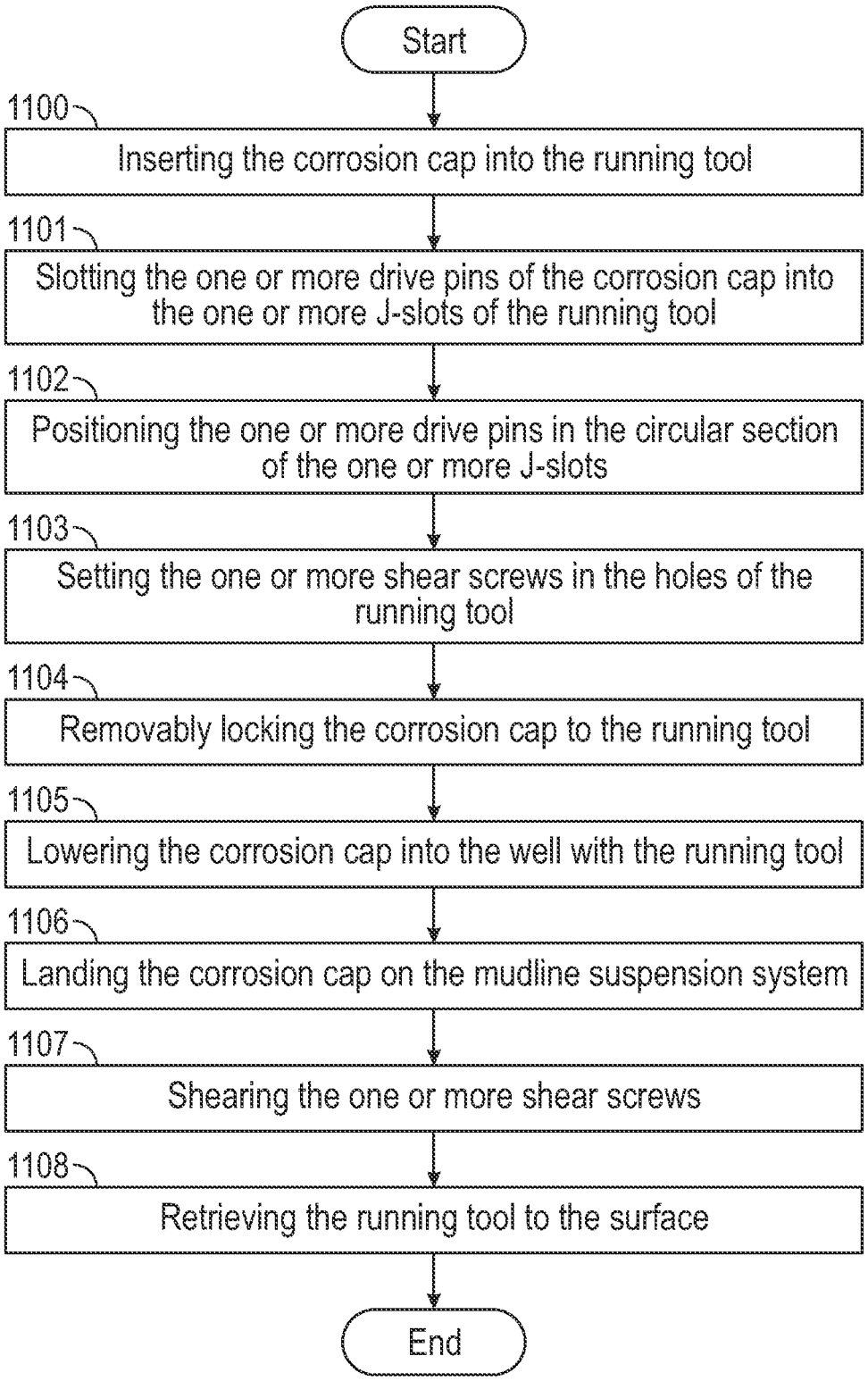
FIG. 12 illustrates a flowchart for installing a corrosion cap with a running tool at a well system according to one or more embodiments of the present disclosure.

Referring to FIG. 12 illustrates a flowchart for installing the corrosion cap with the running tool on an offshore well. One or more steps in FIG. 12 may be performed by one or more components (for example, the computing system coupled to a controller in communication with the offshore well site 1) as described in FIGS. 5-11. For example, a non-transitory computer readable medium may store instructions on a memory coupled to a processor such that the instructions include functionality for operating various equipment on the drilling rig 2.

In step 1100, the corrosion cap is inserted into the running tool. For example, on the derrick, the cap mandrel of the corrosion cap is inserted into the opening of the running tool. Additionally, the opening is at a bottom end of the running such that the corrosion cap is positioned below the running tool.

In step 1101, as the corrosion cap is inserted into the running tool, the one or more drive pins of the corrosion cap are slotted into the one or more J-slots of the running tool. For example, the one or more drive pins protruding radially outward from the cap mandrel are guided through the enlarged portion of the one or more J-slots on the inner surface of the running tool. From the enlarged portion, the one or more drive pins is slotted into the one or more J-slots.

In step 1102, the one or more drive pins are positioned in the circular section of the one or more J-slots. For example, the one or more drive pins move upwards from the enlarged portion of the one or more J-slots and into the vertical section. From the vertical section, the one or more drive pins move into and through the horizontal section to be slotted into the circular section.

In step 1103, with the one or more drive pins positioned in the circular section, the one or more shear screws are set in the holes of the running tool. Said another way, in step 1103, shear screws are installed on the outside part of the running tool to hold the corrosion cap drive pins with the running tool J-slot in its place and preventing it from slipping due to any reason. For example, the one or more shear screws may be inserted in the hole of the running tool accessing the vertical section or the hole of the running tool accessing the horizontal section. The one or more shear screws may be installed in one J-slot or all of them.

In step 1104, the corrosion cap is removably locked to the running tool. For example, the one or more shear screws engage the one or more drive pins to lock the cap mandrel of the corrosion cap within the running tool. By using the one or more shear screws to removably lock the corrosion cap to the running tool, the corrosion cap is prevented from slipping and/or falling from the running tool until the one or more shear screws are sheared by a predetermined force (rotational or axial force).

In step 1105, with the corrosion cap removably locked to the running tool, the corrosion cap is lowered into the well with the running tool. For example, at end distal to the corrosion cap, the running tool is coupled to the tubular string and the tubular string is lowered down the riser from the derrick. The corrosion cap exits the riser to enter the well.

In step 1106, the corrosion cap is landed and threaded on the mudline suspension system. For example, the running tool lowers the corrosion cap to enter the well and land on the mudline suspension system. More specifically, the running tool lands the corrosion cap on the corresponding casing hanger of the mudline suspension system. The corresponding casing hanger is based on the size of the corrosion cap. For example, the corrosion cap is sized to fit the casing hanger size based on each casing string (e.g., the conductor casing, the surface casing, the intermediate casing, or the production casing).

In step 1107, with the corrosion cap landed on the casing hanger, the one or more shear screws are sheared to disengage the corrosion cap from the running tool. That is, a force is applied to shear/break the screw(s) that hold the running tool to the corrosion cap to retrieve the running tool and keep the corrosion cap installed in the well. In one or more embodiments, when the one or more shear screws are set in the hole of the running tool corresponding to the vertical section of the J-slot, the running tool is pulled upward to shear the one or more shear screws. The upward force generated from the pulling the running tool is applied to the one or more shear screws. The one or more shear screws shear once the applied upward force is greater than a predetermined threshold of the one or more shear screws. Alternatively, in one or more embodiments, when the one or more shear screws are set in the hole of the running tool corresponding to the horizontal section of the J-slot, the running tool is rotated to shear the one or more shear screws. The rotation of the running tool generates a torque that is applied to the one or more shear screws. The one or more shear screws shear once the applied torque is greater than a predetermined threshold of the one or more shear screws.

In some embodiments, to confirm the one or more shear screws are sheared, a weight and torque are monitored at the surface with and without the corrosion cap. For example, if torque is needed to shear the one or more shear screws, a maximum allowable torque is applied to the drill string to rotate the running tool to shear the one or more shear screws. Once the drill string begins to spin, the shearing of the one or more shear screws is confirmed. Alternatively, if a pulling force is needed to shear the one or more shear screws, a pulling force is applied to the drill string until the one or more shear screws shear. Once the drill string begins to move upward, the shearing of the one or more shear screws is confirmed.

In step 1108, with the one or more shear screws sheared, the running tool is retrieved to the surface. For example, the running tool is pulled upward with the tubular string to travel upward through the riser and back to the derrick.

With the running tool back at the surface, steps 1100-1108 may be repeated with different sized corrosion caps to land on the various casing hangers of the mudline suspension system. For example, the number of corrosion caps deployed may be based on the number of casing hangers in the mudline suspension system. The corrosion caps are used to cap each casing hanger thereby sealing the bore of the corresponding casing string (e.g., the conductor casing, the surface casing, the intermediate casing, or the production casing). Once all the casing hangers of the mudline suspension system are capped with the corresponding corrosion caps, the riser may be removed to abandon the well. With the riser on the hull of the drilling rig, the drilling rig, may be towed away from the capped well. The capped well may be temporarily or permanently abandoned.

In addition to the benefits described, the systems and methods disclosed herein may improve an overall efficiency and performance of abandonment operations at an offshore well site while reducing cost. Additionally, removably locking the corrosion cap to the running tool with shear screws may prevent the corrosion cap from slipping and/or falling from running tool and decrease potential damage to casing hangers caused from corrosion cap being dropped in the well.

While the method and apparatus have been described with respect to a limited number of embodiments, those skilled in the art, having benefit of this disclosure, will appreciate that other embodiments can be devised which do not depart from the scope as disclosed. Accordingly, the scope should be limited only by the attached claims.

What is claimed is:

1. A method for installing a corrosion cap at an offshore well site, comprising:

inserting the corrosion cap into a running tool;

slotting one or more drive pins of the corrosion cap into one or more J-slots of the running tool;

positioning the one or more drive pins in a circular section of the one or more J-slots;

setting one or more shear screws in holes of the running tool corresponding to a vertical section or a horizontal section of the one or more J-slots;

removably locking the corrosion cap to the running tool;

landing the corrosion cap on a mudline suspension system of a well;

shearing the one or more shear screws to disengage the corrosion cap from the running tool; and retrieving the running tool to a surface above the well.

2. The method of claim 1, wherein shearing the one or more shear screws comprises:

when the one or more shear screws is set in the vertical section, pulling the running tool upward to apply an upward force to the one or more shear screws, wherein the upward force is greater than a predetermined threshold of the one or more shear screws; or when the one or more shear screws is set in the horizontal section, rotating the running tool upward to apply a torque to the one or more shear screws, wherein the torque is greater than a predetermined threshold of the one or more shear screws.

3. The method of claim 1, wherein inserting the corrosion cap into the running tool comprises:

inserting a cap mandrel of the corrosion cap into an opening of the running tool, wherein the opening is at a bottom end of the running tool such that the corrosion cap is positioned below the running tool.

4. The method of claim 3, further comprising:

guiding the one or more drive pins through an enlarged portion of the one or more J-slots;

moving the one or more drive pins through the vertical section from the enlarged portion and into the horizontal section; and continue moving the one or more drive pins through the horizontal section and into the circular section.

5. The method of claim 3, wherein removably locking the corrosion cap to the running tool comprises:

positioning an end of the one or more shear screws into the vertical section or the horizontal section; and locking the cap mandrel of the corrosion cap within the running tool.

6. The method of claim 1, wherein landing the corrosion cap on the mudline suspension system of the well comprises:

lowering the corrosion cap with the running tool through a riser extending from a drilling rig to the well; and landing the corrosion cap on a casing hanger of the mudline suspension system.

7. The method of claim 6, further comprising:

coupling an end of the running tool opposite the corrosion cap to a tubular string.

8. The method of claim 7, wherein retrieving the running tool to the surface above the well comprises:

pulling the running tool upward with the tubular string through the riser and to a derrick of the drilling rig.

9. A method for sealing a well of an offshore well site, comprising:

removably locking a first corrosion cap to a first running tool, wherein the removably locking of the first corrosion cap to the first running tool comprises:

positioning one or more drive pins of the first corrosion cap in one or more J-slots of the first running tool; and setting one or more first shear screws in holes of the first running tool accessing the one or more J-slots;

landing the first corrosion cap on a first casing hanger of a mudline suspension system within the well;

shearing the one or more first shear screws to disengage the first corrosion cap from the first running tool;

retrieving the first running tool to a rig above the well;

removably locking a second corrosion cap to a second running tool, wherein the removably locking of the second corrosion cap to the second running tool comprises:

positioning one or more drive pins of the second corrosion cap in one or more J-slots of the second running tool; and setting one or more second shear screws in holes of the second running tool accessing the one or more J-slots of the second running tool;

landing the second corrosion cap on a second casing hanger of the mudline suspension system;

shearing the one or more second shear screws to disengage the second corrosion cap from the second running tool;

retrieving the second running tool to the rig.

10. The method of claim 9, wherein shearing the one or more first shear screws comprises:

rotating the first running tool upward to apply a torque to the one or more first shear screws, wherein the torque is greater than a predetermined threshold of the one or more first shear screws.

11. The method of claim 9, wherein shearing the one or more first shear screws comprises:

pulling the first running tool upward to apply an upward force to the one or more first shear screws, wherein the upward force is greater than a predetermined threshold of the one or more first shear screws.

12. The method of claim 9, wherein shearing the one or more second shear screws comprises:

rotating the second running tool upward to apply a torque to the one or more second shear screws, wherein the torque is greater than a predetermined threshold of the one or more second shear screws.

13. The method of claim 9, wherein shearing the one or more second shear screws comprises:

pulling the second running tool upward to apply an upward force to the one or more second shear screws, wherein the upward force is greater than a predetermined threshold of the one or more second shear screws.

14. The method of claim 9, further comprising:

removing a riser extending from the rig to the well.

15. The method of claim 14, further comprising:

towing the rig away from the well; and abandoning the offshore well site.

16. A system for installing a corrosion cap on a mudline suspension system, comprising:

the corrosion cap comprising:

a cap, a stab body extending below the cap, and a cap mandrel extending above the cap, wherein one or more drive pins extend radially outward from the cap mandrel;

a running tool having a body extending from a first end to a second end, wherein the running tool comprises:

an opening provided at the second end configured to receive the cap mandrel, one or more J-slots disposed on an inner surface of the body, wherein the one or more J-slots includes a vertical section, a horizontal section, and a circular section interconnected together to form a J-shaped slot, and holes extending through the body at the one or more J-slots, wherein the one or more drive pins are slotted into the one or more J-slots; and one or more shear screws set in the holes to engage the one or more drive pins and removably lock the corrosion cap within the running tool, wherein the one or more shear screws are sheared to disengage the corrosion cap from the running tool to set the corrosion cap on a casing hanger of mudline suspension system.

17. The system of claim 16, wherein an end of the one or more shear screws is positioned in the vertical section of the one or more J-slots.

18. The system of claim 17, wherein the one or more shear screws are sheared by pulling the running tool to apply a pulling force on the one or more shear screws being greater than a predetermined threshold of the one or more shear screws.

19. The system of claim 16, wherein an end of the one or more shear screws is positioned in the horizontal section of the one or more J-slots.

20. The system of claim 19, wherein the one or more shear screws are sheared by rotating the running tool to apply a torque on the one or more shear screws being greater than a predetermined threshold of the one or more shear screws.

* * * * *